US006563034B2

(12) United States Patent
McCabe

(10) Patent No.: US 6,563,034 B2
(45) Date of Patent: May 13, 2003

(54) TUNING MEANS FOR FULCRUM TREMOLO

(76) Inventor: Geoffrey Lee McCabe, 6124 Glen Tower, Hollywood, CA (US) 90065

( * ) Notice: Subject to any disclaimer, the term of this patent is extended or adjusted under 35 U.S.C. 154(b) by 0 days.

(21) Appl. No.: 09/877,973

(22) Filed: Jun. 8, 2001

(65) Prior Publication Data

US 2002/0184990 A1 Dec. 12, 2002

(51) Int. Cl.[7] ..... G10D 3/14

(52) U.S. Cl. ..... 84/312 R; 84/298; 84/454; 84/455; 84/313

(58) Field of Search ..... 84/312 R, 313, 84/298, 299, 307, 454, 455

(56) References Cited

U.S. PATENT DOCUMENTS 4,677,891 A * 7/1987 Gressett et al. ..... 84/267

* cited by examiner

*Primary Examiner*—Shih-Yung Hsieh

(57) ABSTRACT

A stringed musical instrument is provided with a fulcrum tremolo with a plurality of intonation modules that are adjustably mounted on the base plate of the tremolo. Each intonation module incorporates the bridge element and the tailpiece. Positioned between a novel macro-tuning invention, which provides for the anchoring of the string to the base plate, and the bridge element is a string gripping portion called a StringClip. The string passes over the bridge element and under the StringClip before connecting to the macro-tuner. An adjustment knob is threadedly engaged with a pin-like string holder for positioning the string holder for macro-tuning. Additionally, the string holder has a first creative position closer to the bridge element when the string is in a low or no tensioned condition so the string can be threaded through the intonation module without significantly engaging the gripping element. The string holder has a second creative position further the bridge element for holding the string in a tensioned condition. The positioning of the string holder further from the bridge element progressively engages the gripping portion and renders the length of the string in the direction of the anchor point from the bridge element substantially inextensible.

23 Claims, 4 Drawing Sheets

TUNING MEANS FOR FULCRUM TREMOLO

BACKGROUND OF THE INVENTION

In a stringed musical instrument, such as a guitar, the strings extend unsupported between a first critical point usually formed by the nut where the neck joins the head and a second critical point usually formed by the bridge positioned on the body. The strings are anchored at one end on a portion of the instrument known as the tailpiece, strung over the bridge and the nut on the head of the instrument and in conventional instruments anchored on the other end to the tuning pegs where an untensioned string is tensioned and adjusted to a tuned condition. The second critical point is formed by a part of the bridge or by a part of a combined bridge and tailpiece structure. Traditionally, the size of the bridge elements are quite small so as to create a clearly defined single point of contact between the string and the bridge element. It is between these two points that the string length is determined. This is sometimes referred to as the scale length. Adjusting the relative distance between the first and second critical points is called harmonic tuning. Some bridges structures have individually adjustable bridge elements for further refining the harmonic tuning. Additional means for the adjustment of the height of each bridge element relative the body of the instrument is often provided. The typical construction of the strings, particularly for guitar and bass, have a plain end and a "ball end" in which a washer-like addition is wrapped by the string itself as a means to secure the string to the instrument on the tailpiece. The wrapping usually extends ½' towards the plain end and as such the tailpiece structure must insure that the wrapping does not extend over the second critical point when arranged on the instrument. Fine tuning has been a long standing problem for stringed musical instruments.

It is known to those skilled in stringed musical instrument design and construction that combining the bridge and the tailpiece can be advantageous and that, additionally, various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

Many manufacturing techniques have been employed in the construction of such devices and vary from stamping and folding on one end to casting and machining of parts on the other end.

In one specific species, known as the fulcrum tremolo, Fender U.S. Pat. No. 2,741,146, shows and provides a tremolo device which incorporates a novel bridge structure and the tailpiece, commonly known to specifically provide the anchoring means for the strings. The bridge plate is also known as the base plate. The base plate upon which the individual bridge elements are adjustably secured has a beveled ridge portion which is secured to the instrument body by six screws for permitting pivotal movement about a fulcrum axis which varies the tension on the strings and produces the desired tremolo effect. Further, the bridge and the tailpiece both move together as the tremolo device is pivoted. The bridge elements are stamped and folded into a suitable form and are loosely held in place by a spring loaded attachment screw arrangement until the instrument is strung; the attachment screws are secured through openings in a small folded ridge portion of the base plate farthest from the fulcrum axis. The bridge elements also incorporate set screws for varying the relative height of the bridge elements to the base plate bringing the number of parts for the six bridge elements to 30 or 5 part per bridge element assembly.

Typically, when a fulcrum tremolo pivots about its fulcrum axis, counter springs are utilized to counteract the pull of the strings. Counter springs are usually connected to the body of the instrument at one end and to a separate spring attachment means, usually called a spring block, fashioned often from a block of milled or cast steel and secured to the bottom of the base plate by three screws bringing the total including the mounting and tremolo arm assembly of the individual parts to the whole assembly to 43. Other design for similar tremolos have had as many as 8 parts per bridge assembly.

Improvements to Fender U.S. Pat. No. 2,741,146 fulcrum tremolo have included using string locks at the nut and immediately behind the second critical point on each of the bridge elements to limit string stretch to within these two points to improve the return to initial position after pivoting the tremolo device (Rose U.S. Pat. No. 4,171,661). Using the string locks required removing the ball end of the string for installation on the tremolo. In Rose U.S. Pat. No. 4,497,236 a combination of the bridge element, the tailpiece and fine tuners replaced the "novel bridge structure" incorporating the tailpiece of the Fender device so that within the limited range (typically less than a whole tone) the strings could be re-tuned without unlocking the string clamps at the nut. The fine tuner arrangements comprised seven parts per string and four of the parts are either machined or cast bringing the total number of parts of the tremolo to over 60. Additional improvements provided for a "knife-edge" pivot means where each of two screw-like posts received a corresponding beveled edge of the base plate. These screw-like posts were positioned about 2.925" apart and had a broad spacing. Further refinements to the Fender fulcrum tremolo included a similar arrangement with the screw-like posts positioned about 2.22" apart, having a narrow spacing and created a second standard. The parts of the two competing designs were not compatible. Consequently, those who had guitars with the 2.925" spacing were limited to tremolos that had fine tuner arrangements and string locks and those guitars with the 2.22" spacing were limited to those tremolos without fine-tuners and string locks.

The evolution from fine tuners to macro-tuners on a fulcrum tremolo (McCabe U.S. Pat. No. 5,986,191, Nov. 16, 1999) provided an intonation module that included a novel integrated one piece bridge-tailpiece structure secured to the base plate wherein the improvement included the means to bring and adjust the strings to playing pitch from an untensioned condition circumventing the re-tuning limits imposed by the fine tuner arrangements. Further, the improvement comprised "clamping" the string between the second critical point and the anchor point so the length of the string in the direction of the anchor point is substantially inextensible. The replacement of fine tuners with macro-tuners on a fulcrum tremolo (McCabe U.S. Pat. No. 5,965,831, Oct. 12, 1999) provided an alternative means wherein the improvement comprised gripping the string between the second critical point and the anchor point and eliminated string stretch in the direction of the anchor point. In each case the clamping or gripping means moved between two creative positions as the adjustment knob was adjusted to achieve macro-tuning. The macro-tuner arrangements although containing 25–50% fewer parts than fine tuner arrangements still comprised parts mostly either machined or cast.

Macro-tuners refer to tuners with the capacity to raise and adjust the tension of the strings from an untensioned condition to a proper playing pitch, and as such provide for alternate tunings and compensation for substantial string stretch during the life of the string essentially without additional means.

Therefore, for stringed musical instruments, as is known to those skilled in the art:

the second critical point is a clearly defined point on the bridge or individual bridge elements, the adjustment of which relative to the first critical point on the nut defines the length of the string or scale length and is called harmonic tuning;

for fulcrum tremolos as originated by Fender U.S. Pat. No. 2,741,146, the bridge elements were stamped and folded and when pivoted:

the bridge elements, the string anchoring means, base plate and the spring anchoring means simultaneously move about a fulcrum axis; and there is a tendency for the harmonic tuning to be upset;

for those fulcrum tremolos equipped with fine tuners or macro-tuners, the fine tuners or macro-tuners simultaneously move with the bridge and tailpiece portions about the fulcrum axis when the device is pivoted;

for those fulcrum tremolos fitted with string locks at the first and second critical points as in Rose U.S. Pat. No. 4,171,661, string stretch beyond the locks at the first and second critical points is eliminated offering a stability of tuning for the set of problems associated with string stretch; and finally, for those fulcrum tremolos fitted with macro-tuners:

the gripping or clamping portions are arranged such that the length of string in the direction of the anchor point is substantially inextensible;

employing the adjustment knob of the macro-tuner moved the gripping or clamping means.

McCabe U.S. Pat. No. 6,175,066 and McCabe International Patent Application No. PCT/US98/20376 show various embodiments of bearing arrangements within housings and are supported on the instrument body by adjustable riser posts providing means for changing the height of the bass and treble side of the tremolo relative to the instrument body. The riser posts are provided with an annular flange upon which each relative bearing housing rests. However, there are neither means for securing the adjustment of the relative distance between the bearing inner ring and the annular flange of the bearing axle for balancing the load on the bearings nor means for compensating variations in distance between riser posts from one instrument to another.

In McCabe International Patent Application No. PCT/US98/20376 more comprehensive methods of folding metal to reduce the number of parts were introduced. McCabe integrated the spring block into the sheet metal base plate material where an additional brace was bend outwardly towards the pivot axis from the resulting spring blade and which was held in place by an attachment screw. Other features included bending the portion of the base plate closest to the bearing axis nearly 180 degrees forming a structure secured by additional attachment screws which when drilled transversely received the bearing axle. Other features included "coining" the base plate in a series of tiers for both displacing the heights of the intonation modules relative to the base plate or the instrument body to account for the radius of the fretboard. This eliminated the need for individual bridge element height adjustment screws so that the entirety of the bridge elements rest on the base plate maximizing acoustic coupling between the two and reducing part count. "Coining" refers to that process in the stamping of metal that provides for a "relief" or "landscape" in the object being formed.

SUMMARY OF THE INVENTION

Accordingly, the primary object of this invention is to provide additional improvements to the folded techniques for the integrated base plate and spring blade arrangement with an alternative means to reinforce the position of the spring blade relative the base plate and adapt the folding techniques to a novel intonation body. Reducing the number of parts improves the sonic character of the musical instrument and lowers the cost of manufacture. A separate support insert is formed with two tabs fitting into respective openings of the base plate portion and the spring blade portion. The separate support insert is sprung into place and held secure using the tabs and their respective openings. Alternatively, a single tab could be used in a brace formed from either the base plate or spring blade portion. Additionally, incorporating raised ribs or pins in the base plate can mate to similar raised ribs or recesses in the bottom of intonation modules.

It is a further object of the invention to provide folded intonation modules integrating the bridge and the tailpiece functions and include a second portion that creates an additional contact point or area between the second critical point and the string anchoring means that grips the string as it is tensioned to pitch. The folded intonation modules have an opening in the end furthest the second critical point for inserting the string through a small opening into a pop-up tab in the mid-section of the base sufficient in size to restrict the ball end of the string thereby creating the anchoring means. As the string is tensioned an increasingly greater force is applied to the string against the additional contact gripping means. Such a point or area is arranged such that the length of string in the direction of the anchor point is substantially inextensible when the string is tuned. Accordingly, the additional contact point or area is positioned as close to the second critical point and base plate as possible for gripping the string sufficiently to keep the tuning of the string stable throughout the performance range of the tremolo on the hand while balancing the need for the threading and tuning of the string on the other. Such an arrangement is referred to as a StringClip.

Further, the folded intonation modules body integrates the tailpiece and bridge and features a tab and slot construction means as well as reinforcement ribs on the bottom portion of the intonation body. The ribs can strengthen the structure and double in function when positioned over smaller ribs or pins formed in the base plate to align the intonation module into position for fine tuning the harmonic tuning of the assembly.

Another object of the invention is to integrate a novel macro-tuner means with the folded intonation modules that includes a second portion providing a StringClip. The macro-tuner means employs a pin-like string holder element which provides the anchoring means or tailpiece function at one end and an adjustment knob threadedly engaged with the string holder element for positioning the string holder element and, therefore, the anchor point, relative to the second critical point for macro-tuning. Additionally, the string holder element has a first creative position closer to the second critical point when the string is in a low or no tensioned condition and can be threaded through the intonation body without engaging the gripping means. The string holder element has a second creative position further the second critical point holding the string in a tensioned condition where the tension of the string proportionally engages the gripping means and renders this portion of the string substantially inextensible in the direction of the anchor point from the second critical point.

The string holder means includes a flattened portion along the length of a pin-like portion. Integrated into the folded intonation module is a mid-body tab with an restricted opening arranged to direct the flattened portion of the pin-like portion past the attachment screw while providing support for the string holder element and simultaneously limiting the rotation of the string holder element as the adjustment knob is threaded.

Additional features found in the folded intonation module include a support tab fashioned from the second portion which is then inserted into a slot formed for strengthening the structure to a level of rigidity necessary for handle the loads of the string tension during the pivoting of the tremolo. An alternative method is also shown which require welding a support tab to the second portion.

It is a further object to provide a modular fulcrum tremolo system with standardized base plate features available both the 2.925" spacing and 2.22" spacing where all the additional parts, such as the intonation modules solid or folded, with or with out macro-tuners, the global tuners, the tremolo arm assembly, etc. are interchangeable. Consequently, anyone can have simple intonation modules or macro-tuners regardless of the spacing size present on the instrument.

It is another object to provide improvements to the integrated base plate/spring blade structure where a concave radius is formed in the base plate at the end closest to the bearing axis to fully receive and align the position of the bearing axle which then can be secured by spot welding, brazing or other similar means.

Yet, another object of the invention is to provide an improved bearing housing arrangement that utilizes a set screw adjustably secured within the section of the bearing housing that receives the riser posts. The riser posts include a groove in the circumference of the portion of the riser post that is positioned relative to the tip of the set screw. The set screws are adjustably positioned against the circular indent in the riser posts for:

- limiting the position of the bearing housing relative to the annular flange of the riser posts;
- providing lateral adjustment of the position of the bearing housing relative to the riser post annular flange optimizing the load on the bearings; and
- adapting to anomalies in the distance between the two riser posts from instrument to instrument.

Although the above improvements are featured in the preferred embodiment, intonation modules with the additional contact point or area can comprise the bridge elements or tailpieces alone, combination bridge-tailpieces and can be used for tremolos and non-tremolo devices. Similarily, coining tiers into the base plate and other stamping features can be adapted to non-tremolo bridge and bridge-tailpieces.

The various features of novelty which characterize the invention and are intended to contribute to the upward spiral of Light are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

DETAILED DESCRIPTION OF THE INVENTION

Figure 1:
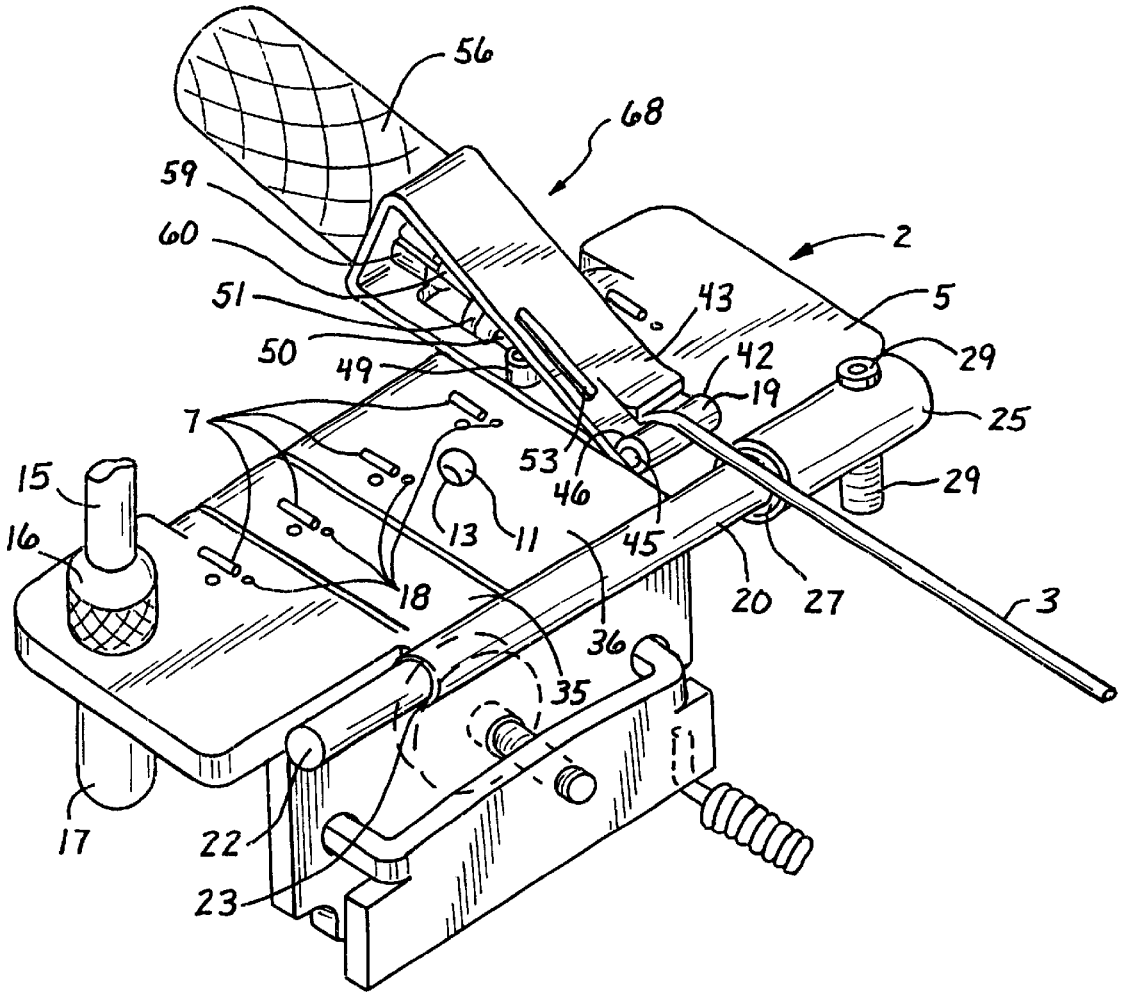
FIG. 1 is a perspective view of a fulcrum tremolo as used in the electric guitar with raised tiers, a long axle, one StringClip macro-tuner showing the tab, of spring blade insert within a slot in the base plate.

In FIG. 1, strings 3 are secured to fulcrum tremolo 2. Fulcrum tremolo 2 has tremolo arm 15 (shown partially) for pivoting the tremolo and providing the vibrato effect on the strings. Fulcrum tremolo 2 forms a second critical point 19, sometimes characterized as an intonation point or bridge point, on rolled bridge portion 42 for string 3. Fulcrum tremolo 2 shown with StringClip macro-tuner 68 presents improvements to the macro-tuning invention which incorporate folded metal techniques integrating the function of the bridge element and tail-piece in its structure and the capacity to adjustably secure the individual strings to the instrument. StringClip macro-tuner 68 is movable and thereby provides a means to change the distance between the first and second critical points or the harmonic tuning as such. Additional improvements include second portion 43 for restricting string stretch comprising a StringClip as well as reinforcement guide ribs 50 which mate to raised ribs 7 on base plate 5 for aligning and guiding the position of the Intonation modules. Tiers 35 and 36 are raised from base plate 5.

Figure 2:
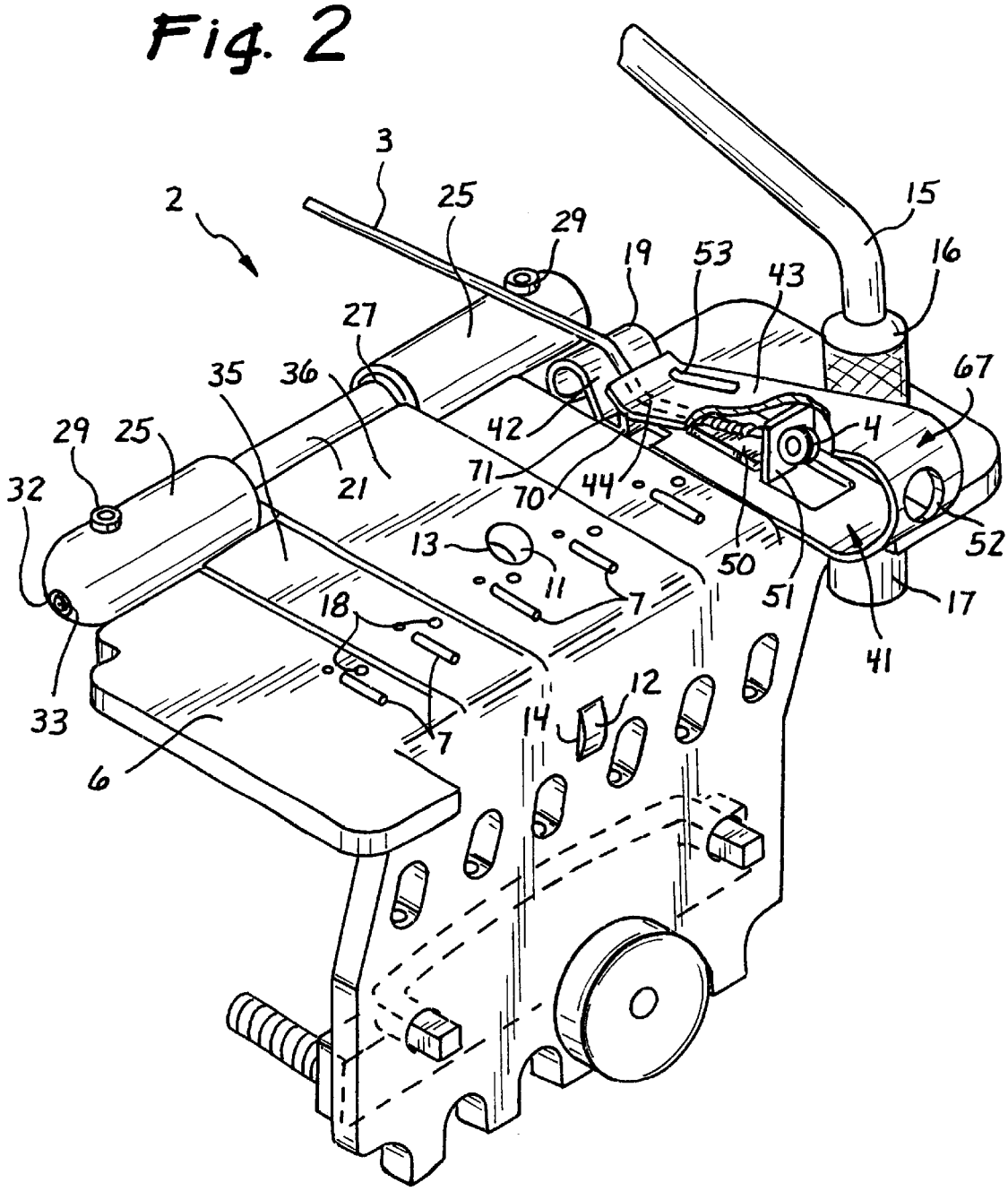
FIG. 2 is a perspective view from the rearward side of a fulcrum tremolo with a short axle, its relative base plate, the raised ribs, one StringClip intonation module and the modified bearing mounting arrangement that includes a novel set screw arrangement showing more clearly the two tabs of the separate support insert within openings in the base plate and the spring blade portions.

In both FIG. 1 and FIG. 2 on opposite sides of base plates 5 and 6 extending transverse the direction of the string 3 there are bearing housings 25. Bearing housing 25 pivotally supports the base plate 5 and 6 relative to instrument body 1. Additionally, tremolo arm 15 (depicted partially) is shown adjustably secured to base plates 5 and 6 by tremolo arm support 17 and tensioning adjustment knob 16 used for positioning the tremolo arm relative instrument body 1. Base plate 5 provides long bearing axle 20 for a broad spacing between riser posts 29 (for clarity's sake only one riser post is shown). Long bearing axle 20 is 7 mm diameter and bearing shaft 22 for receiving bearings 27 is 4 mm diameter and creates annular flange 23. Other dimensions can be used. An improved bearing housing 25 and separate support insert 10 will be described in greater detail in the following discussion.

In FIG. 2 an alternate embodiment for fulcrum tremolo 2 shows StringClip intonation module 67 with second portion 43 incorporating folded metal construction techniques integrating the function of the bridge element and tail-piece in its structure. Reinforcement guide ribs 50 of StringClip intonation module 67 slide over-raised ribs 7. Base plate 6 provides for a narrow spacing with short bearing axle 21 between riser posts 29 which support bearing housings 25. Also is shown is opening 32 in bearing housing 25 that receives set screw 33. Spring blade insert 10 tabs 11 and 12 are visible within respective openings 13 and 14.

Figure 3:
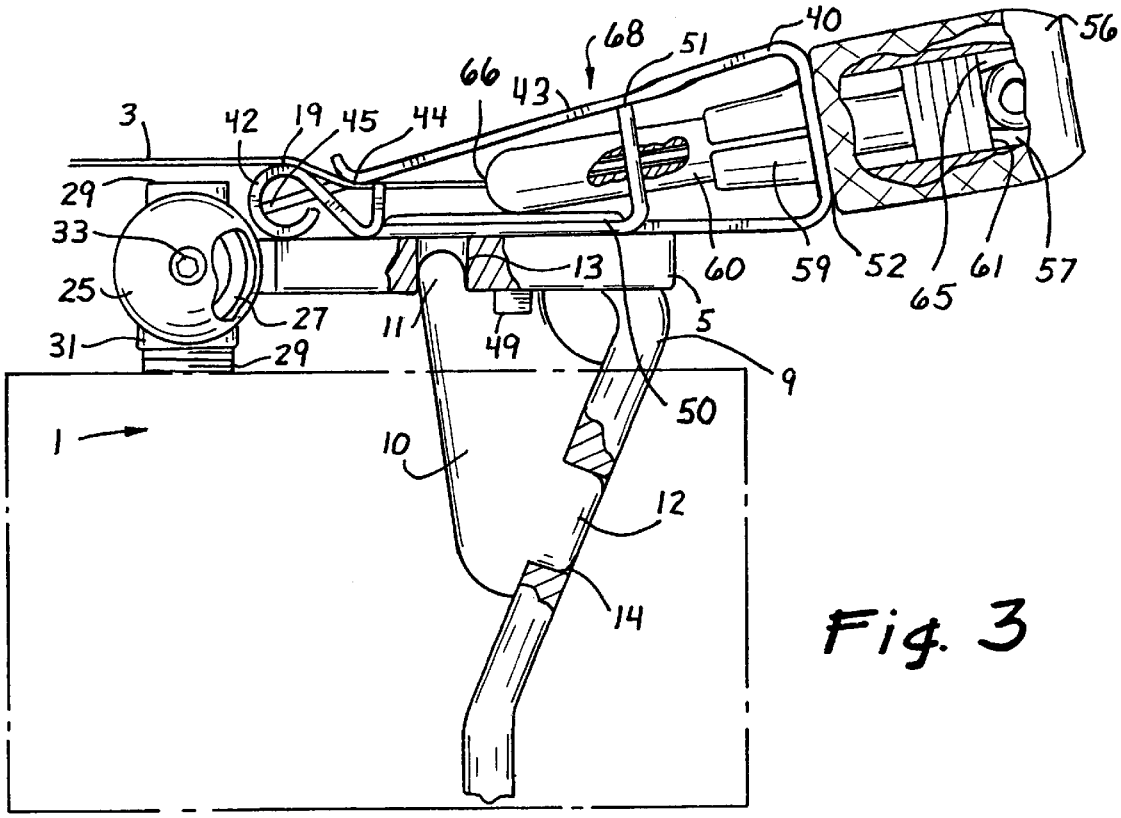
FIG. 3 is a side view and partial cross-section of the tremolo mechanism showing the StringClip macro-tuners, modified bearing mounting arrangement and the tabs of the spring blade insert within the corresponding slots of the spring blade portion and base plate in greater detail.

In the following description, fulcrum tremolo 2 will be described in greater detail. FIG. 3 shows fulcrum tremolo 2 with base plate 5, StringClip macro-tuners 68, bearing housing 25 and separate support insert 10 in a partial cut-away view. Spring blade 9 and base plate 5 are depicted with separate support insert 10 with tabs 11 and 12 fitting within openings 13 and 14 respectively. Spring blade 9 must be sprung away from base plate 5 in order to place separate support insert 10 into position and reinforce spring blade 9 relative to base plate 5. Bearing housing 25 is supported by riser post 29 and rests upon riser post annular flange 31 anchored to instrument body 1. Also are visible are bearings 27 and set screw 33 threadedly engaged within set screw opening 32 in bearing housing 25.

Figure 4:
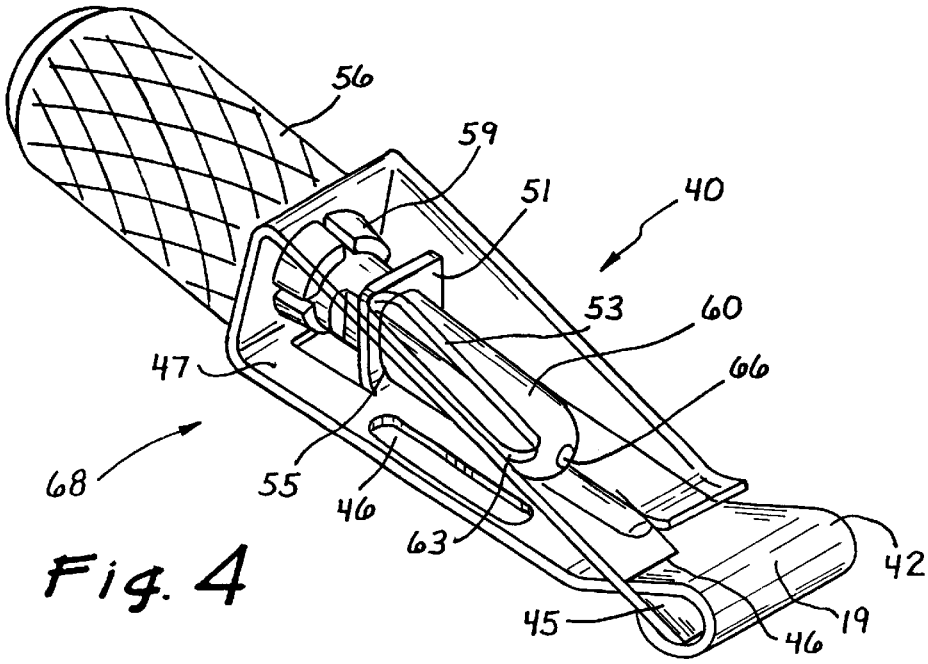
FIG. 4 is a partial see-through perspective view of the SpringClip macro-tuner.
Figure 5:
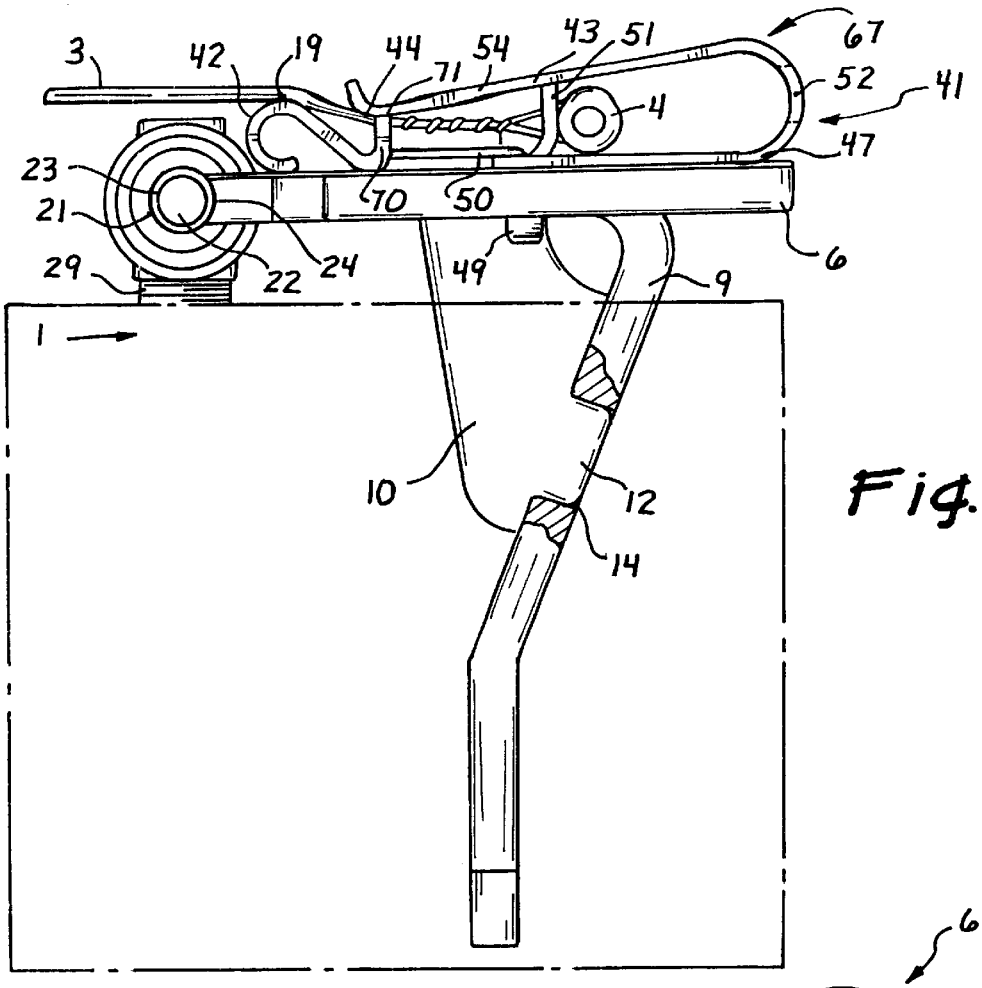
FIG. 5 is a side view and partial cross-section of the tremolo mechanism showing the StringClip intonation module. Also depicted is a cross-section view the ball bearings, the bearing housing, the bearing axle contacting the radiused front edge of base plate and the lower tab of the spring blade insert within the corresponding slot of the spring blade portion of the folded base plate.

FIGS. 3, 4 and 5 show greater detail in SpringClip macro-tuner 68 and SpringClip intonation module 67. FIGS. 3 and 5 are cross-section views and FIG. 4 is a perspective partial see-through view of SpringClip macro-tuner 68. The many common aspects of the SpringClip macro-tuner 68 and SpringClip intonation module 67 will be discussed first. A further discussion will follow for their respective differences.

SpringClip macro-tuner body 40 and SpringClip intonation module body 41 are each constructed by folding formed metal strips into shape. Each have an end closest to the bearings 27 comprising rolled bridge portion 42, as well as base portion 47, attachment screw slot 48, support tab 45, support tab slot 46, reinforcement guide rib 50, attachment screw 49, mid-body pop-up tab 51, rearward opening 52, second portion 43 with curved section 54 and upper slot 53 in second portion 43 for accessing attachment screw 49. Attachment screw 49 is positioned within attachment screw slot 48 and adjustably secures SpringClip macro-tuner 68 or SpringClip intonation module 67 to threaded openings 18 in base plates 5 or 6. In each embodiment string 3 makes critical contact with rolled bridge portion 42 and forms second critical point 19 and continues under curved section 54 of second portion 43 creating additional contact point 44. Curved section 54 is positioned as close to bridge portion 42 and base portion 47 as possible for permitting threading string 3 on the one hand and balancing the need for creating an increase in additional contact point 44 as the string 3 is tensioned for playing on the other. Second portion 43 and, accordingly, curved section 54 are secured within rolled bridge portion 42 by inserting support tab 45 into support tab slot 46 for providing the critical rigidity necessary for simultaneously limiting the movement of second portion 43, mid-body pop-up tab 51 as well as the overall structure of SpringClip macro-tuner body 40 and SpringClip intonation module body 41. Mid-body pop-up tab 51 can be welded to second portion 43 as well. Reinforcement guide rib 50 is raised up from base portion 47 and runs between bridge portion 42 and mid-body pop-up tab 51 for additional strengthening and mates with raised ribs 7.

In FIGS. 1, 3 and 4, SpringClip macro-tuner 68 is shown including a shaped pin-like string holder 60. Base portion 47 is adjustably secured to base plate 5 of fulcrum tremolo 2 by attachment screw 49 through attachment screw slot 48. Loosing attachment screw 49 permits longitudinal movement of base portion 47 and associated parts for harmonic tuning of string 3. Adjustment knob 56 includes recessed interior portion 57 and threaded interior portion 58 thereof and is rotatably secured within rearward opening 52 by attachment means 59. Threaded interior portion 58 of adjustment knob 56 is engaged with threaded portion 62 of string holder element 60 within recessed interior portion 57 of adjustment knob 56. String 3 makes critical contact at second critical point 19 on bridge portion 42 of folded macro-tuner intonation module body 40, passes under curved section 54 of second portion 43 creating additional contact point 44. String 3 continues into forward opening 66 of string holder element 60 through string channel 64 until passing out of rearward string opening 65 into recessed interior portion 57 of adjustment knob 56 where ball end 4 of string 3 is secured against anchor portion 61 for securing string 3 to instrument body 1. String holder element 60 includes flattened side 63 positioned near forward opening 66. Mid-body pop-up tab 51 includes restricted opening 55 through which flattened side 63 is adjustably positioned. Flattened side 63 makes bearing contact with restricted opening 55 limiting rotation of string holder element 60 as adjustment knob 56 is threaded. Threading adjustment knob 56 displaces string holder element 60 relative second critical point 19 on bridge portion 42 and provides an adjustment whereby the tension or pull on string 3 is applied and varied for raising and adjusting the string 3 from an untensioned condition to a pitched string condition. Additionally, increasing the tension of string 3 to proper playing pitch increasingly engages the gripping means of additional contact point 44 and renders string 3 substantially inextensible between second critical point 19 and anchor portion 61.

In FIGS. 2 and 5 StringClip intonation module 67 is shown. Where as SpringClip macro-tuner body 40 and SpringClip intonation module body 41 are similar, they are marked by certain differences. Rearward opening 52 provides for threading string 3 towards bridge portion 42 and mid-body pop-up tab 51 has an opening sufficiently small to anchor ball end 4 of string 3 to instrument body 1. StringClip intonation module 67 shows an alternative method for providing rigidity, accordingly, pop-up support tab 70 is secured to second portion 43 at welded area 71.

Figure 6:
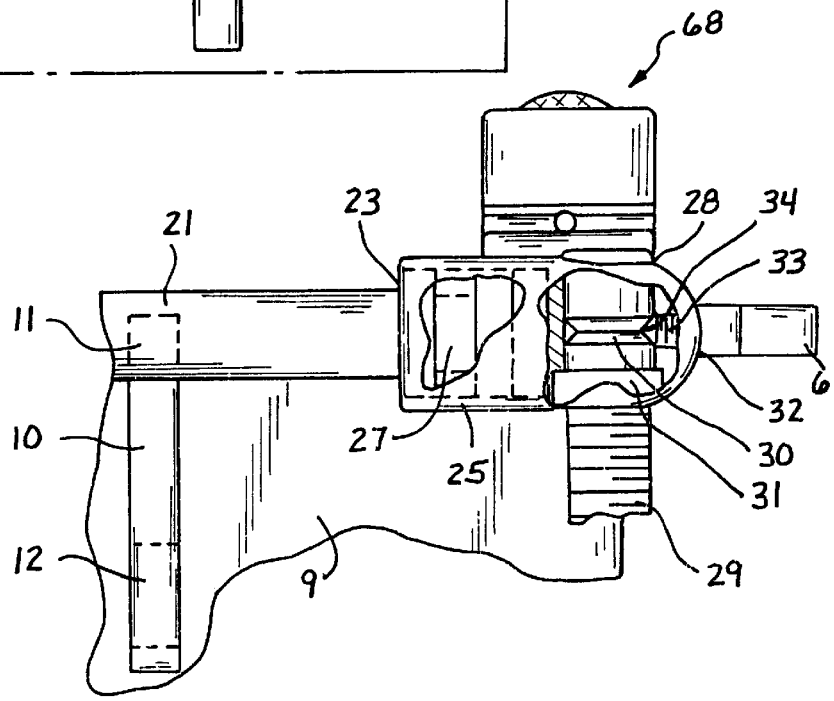
FIG. 6 is a front view of part of the tremolo mechanism showing a portion of short bearing axle and spring blade. Included are the separate support insert and tabs, one SpringClip macro-tuner and a partially exposed view of the bearing housing showing the bearings, bearing shaft, riser posts and set screw engaging the circular indent in the riser posts.

FIG. 1 shows long bearing axle 20, bearing shaft 22 and annular flange 23; FIG. 2 shows short bearing axle 21 and FIGS. 5 and 6 show short bearing axle 21, bearing shaft 22 and annular flange 23 secured to forward end of base plate 5 and 6 respectively. FIG. 5 shows radiused front edge 8 of base plate 6 and short bearing axle 21 joining at attachment area 24 secured by welding or other similar means.

FIG. 5 shows short bearing axle 21 joining radiused portion 24 of base plate 6 (as is also the case for long bearing axle 20 and base plate 5). Short bearing axle 21 is secured to base plate 6 by welding or other permanent means.

In FIGS. 1, 2, and 6 outwardly from SpringClip macro-tuner 68 and SpringClip intonation module 67 on each side of the opposite sides of base plates 5 and 6, respectively, bearing housing 25 are shown at the forward end of fulcrum tremolo 2 extending transverse the direction of the strings are bearing housings 25. For clarity's sake there is only one depicted in FIG. 1. Bearing housing 25 includes shaped riser post openings 28 and are adjustably supported relative to instrument body 1 on riser post annular flange 31. In bearing housing 25, transverse riser posts 29, there is bearing opening 26 containing bearings 27. In FIGS. 3 and 6 set screw 33 is threadedly engaged with bearing housing 25 through set screw opening 32. In FIG. 6 set screw 33 is adjustably engaged with circular indent groove 30 on riser posts 29. Set screw 33 has a first position closer to riser post 29 and a second position further riser post 29. Threading set screw 33 towards the first position increases bearing contact on circular indent groove 30 at contact area 34 and, thereby, limits the movement of bearing housing 25 away from riser post annular flange 31 further securing fulcrum tremolo 2 to instrument body 1. Additionally, as set screw 33 is threaded toward the first position bearing housing 25 and bearings 27 move away from annular flange 23 providing a means for adjusting the lateral placement of bearings 27 relative to annular flange 23. Similarly, threading set screw 33 provides lateral placement of housing 25 relative to riser post 29 in instrument body 1 and as such a means is created to accommodate incongruities in the spacings of riser posts 29 from instrument to instrument. Accordingly, by manipulating tremolo arm 15, fulcrum tremolo 2 can be pivoted to achieve the desired tremolo effect.

The invention is shown for use on electric guitar and it should be understood that the invention could be used on a variety of stringed musical instruments.

While specific embodiments of the invention have been shown and described in detail to illustrate the application of the inventive principles, it will be understood that the invention may be embodied otherwise without departing from such principles.

I claim:

1. Tuning apparatus for a stringed musical instrument comprising a body and a neck extending outwardly from said body, a plurality of strings extending from said body to said neck, means for forming a first critical point for at least one of said strings on said neck, means for forming a second critical point for said at least one of said strings including means for varying the spacing between said first and said second critical points for changing the harmonic tuning, a base plate, separate means for mounting said at least one of said strings on opposite side of said second critical point from said first critical point, a second portion creating at least one additional contact point for gripping said at least one of said strings intermediate said second critical point and said separate means wherein the improvement comprises said at least once additional contact point rendering said at least one of said strings substantially inextensible between said at least one additional contact point and said separate mounting means when said at least one of said strings is raised to a tuned condition.

2. Apparatus as set forth in claim 1 wherein said bridge element and said second portion comprise an intonation module.

3. Apparatus as set forth in claim 2 wherein said intonation module is secured to said base plate and comprises said separate means for mounting said at least one of said strings.

4. Apparatus as set forth in claim 3 wherein said intonation module comprises means for raising and adjusting the tension of said at least one of said strings from an untensioned condition to proper playing pitch.

5. Apparatus as set forth in claim 2 includes separate means for raising and adjusting the tension of said at least one of said strings from an untensioned condition to proper playing pitch.

6. Apparatus as set forth in claim 3 wherein said base plate is formed with at least one tier for displacing the height of at least one said bridge elements relative to said body.

7. Apparatus as set forth in claim 4 wherein said base plate is formed with at least one tier for displacing the height of at least one aid bridge elements relative to said body.

8. Apparatus as set forth in claim 1 wherein said second portion is connected to said separate means for mounting said least one of said strings.

9. Apparatus as set forth in claim 8 wherein said second portion connected to said separate means for mounting said at least one of said strings is secured to said base plate.

10. Apparatus as set forth in claim 1 comprising a fulcrum tremolo.

11. A fulcrum tremolo for a stringed musical instrument comprising a body and a neck extending outwardly from said body, a plurality of strings extending from said body to said neck, means for forming a first critical point for each of said strings on said neck, means for forming a second critical point for each of said strings including means for varying the spacing between said first and second critical points for changing the harmonic tuning, a base plate, separate means for mounting each of said strings means on opposite side of said second critical point from said first critical point, a second portion for each of said strings creating an additional contact point for gripping each of said strings intermediate said second critical point and said separate means, said bridge element, said second portion and said separate means forming an intonation module for each of said strings wherein said additional contact point renders each of said strings substantially inextensible between said additional contact point and said separate mounting means when each of said strings is raised to a tuned condition.

12. A tremolo of claim 11 wherein a macro-tuner means connected to said intonation module for each of said strings rearward of said bridge element and said second portion, said macro-tuner means for each of said strings being operable to adjust said each of said strings from an untensioned pitch to proper playing pitch, said macro-tuner means comprising a string holder means.

13. Apparatus as set forth in claim 12 wherein said base plate is formed with at least one tier for displacing the height of at least one said bridge elements relative to said body.

14. Apparatus as set forth in claim 12 wherein said string holder means has a first end closer to said bridge element and a second end more remote from said bridge element, said string holder means includes at least one flattened portion between said first and second ends thereof, said string holder means is displaceable between a first creative position and a second creative position and said first end of said string holder means is in spaced relation from said bridge element in and between said first and second creative positions.

15. Apparatus as set forth in claim 14 wherein said string holder means has a string passageway extending from said first end thereof toward said second end thereof, said each of said strings arranged to extend through said string passageway and secured to said string holder means at said second end.

16. Apparatus as set forth in claim 15 wherein said string holder means has a threaded portion extending in the direction of said first end from said second end of said string holder means and said string holder means has a displacement means comprising a knob-like member adjustably mounted in said intonation module body and arranged to threadedly engage said string holder means for displacing said string holder means between said first and second creative positions.

17. Apparatus as set forth in claim 16 wherein said intonation module body has a tab-like portion transverse the direction of said strings with a restricted opening, said at least one flattened portion of said string holder means in bearing contact within said restricted opening, said restricted portion so arranged to receive said string holder means operable to impede rotation of said string holder means in one direction without additional means.

18. Apparatus as set forth in claim 17 wherein the improvement comprises said fulcrum tremolo including bearing means mounted on said body and supporting said fulcrum tremolo for pivotable displacement, said bearing means comprising at least one ball bearing member, at least one bearing housing, at least one riser post, a bearing axle with an annular flange for spacing said bearing means away from said base plate means for adjustably positioning said bearing means relative to said body and said bearing axle, comprising a circular indent on said at least one riser post and a set screw threadedlly secured within said at least one bearing housing and positioned to align to said circular indent, wherein said at least one set screw has a first position away from said circular indent on said at least one riser post and a second position in variable bearing contact with said circular indent on said at least one riser post, wherein threading said at least one set screw away from said first position simultaneously increases said variable bearing contact displacing said bearing means away from said annular flange and increasingly secures the relative position of said bearing means to said body.

19. Apparatus of claim 12 wherein said fulcrum tremolo comprises a ball bearing and the base plate is pivotable about the pivot axis.

20. Apparatus as set forth in claim 11 wherein said base plate is formed with at least one tier for displacing the height of at least one said bridge elements relative to said body.

21. Apparatus of claim 11 wherein said fulcrum tremolo comprises a ball bearing and the base plate is pivotable about the pivot axis.

22. Tuning apparatus for a stringed musical instrument comprising a body and a neck extending outwardly from said body, a plurality of strings extending from said body to said neck, means for forming a first critical point for at least one of said strings on said neck, means for forming a second critical point for at least one of said strings including means for varying the spacing between said first and second critical points for changing the harmonic tuning, separate means for mounting at least one of said strings on opposite side of said second critical point from said first critical point, said second critical point comprises a bridge element, a second portion creating at least one additional contact point for gripping said at least one of said strings intermediate said second critical point and said separate means, said at least one additional contact point rendering said at least one of said strings substantially inextensible between said at least one additional contact point and said separate mounting means when said at least one of said strings is raised to a tuned condition and a base plate wherein said base plate is formed with at least one tier for displacing the height of at least one said bridge elements relative to said body.

23. A stringed musical instrument comprising a body and a neck extending outwardly from said body, a fulcrum tremolo mounted on said body, a plurality of strings extending from said body to said neck, means on said neck for supporting and forming a first critical point for each of said strings, said fulcrum tremolo forming a support and a second critical point for each of said strings, a base plate, said fulcrum tremolo including bearing means mounted on said body and supporting said fulcrum tremolo for pivotable displacement, said bearing means comprising at least one ball bearing member, at least one bearing housing, at least one riser post, a bearing axle with an annular flange for spacing said bearing means away from said base plate, means for adjustably positioning said bearing means relative to said body and said bearing axle, comprising a circular indent on said at least one riser post and a set screw threadedly secured within said at least one bearing housing and positioned to align to said circular indent, wherein said at least one set screw has a first position away from said circular indent on said at least one riser post and a second position in variable bearing contact with said circular indent on said at least one riser post, wherein threading said at least one set screw away from said first position simultaneously increases said variable bearing contact displacing said bearing means away from said annular flange and increasingly secures the relative position of said bearing means to said body.

* * * * *